US009145706B2

(12) United States Patent
Lee

(10) Patent No.: US 9,145,706 B2
(45) Date of Patent: Sep. 29, 2015

(54) POST ANCHOR APPARATUS

(71) Applicant: DuBose Industries, Inc., Clinton, NC (US)

(72) Inventor: Richard Lee, Clinton, NC (US)

( * ) Notice: Subject to any disclaimer, the term of this patent is extended or adjusted under 35 U.S.C. 154(b) by 0 days.

(21) Appl. No.: 14/463,974

(22) Filed: Aug. 20, 2014

(65) Prior Publication Data

US 2014/0352235 A1 Dec. 4, 2014

Related U.S. Application Data

(63) Continuation of application No. 13/944,803, filed on Jul. 17, 2013, now Pat. No. 8,839,572.

(60) Provisional application No. 61/672,980, filed on Jul. 18, 2012.

(51) Int. Cl.

| | |
|---|---|
| ***E02D 7/22*** | (2006.01) |
| ***E04H 17/22*** | (2006.01) |
| ***E04H 17/26*** | (2006.01) |
| ***E04H 12/22*** | (2006.01) |

(52) U.S. Cl.

CPC *E04H 17/22* (2013.01); *E02D 7/22* (2013.01); *E04H 12/2223* (2013.01); *E04H 12/2269* (2013.01); *E04H 17/263* (2013.01)

(58) Field of Classification Search

CPC ... E04H 17/22; E04H 17/263; E04H 12/2223; E04H 12/2269; E02D 7/22

USPC ..... 52/155, 156, 157, 165, 169.13, DIG. 11; 248/155, 545; 256/DIG. 5

See application file for complete search history.

(56) References Cited

U.S. PATENT DOCUMENTS

| | | | | | |
|---|---|---|---|---|---|
| 632,966 | A | * | 9/1899 | Mullenix | 52/158 |
| 3,342,444 | A | * | 9/1967 | Nelson | 52/165 |
| 3,698,144 | A | * | 10/1972 | Stratton | 52/99 |
| 4,459,787 | A | * | 7/1984 | Wilcox | 52/155 |
| 4,858,876 | A | * | 8/1989 | Moreno | 248/545 |
| 4,863,137 | A | * | 9/1989 | Cockman et al. | 248/545 |
| 4,923,165 | A | * | 5/1990 | Cockman | 248/545 |
| D314,328 | S | * | 2/1991 | Cobb | D8/373 |
| 5,011,107 | A | * | 4/1991 | Reece | 248/545 |
| 5,456,441 | A | * | 10/1995 | Callies | 248/521 |
| 5,927,677 | A | * | 7/1999 | Speece et al. | 248/516 |
| 6,272,798 | B1 | * | 8/2001 | Cockman | 52/155 |
| 6,298,611 | B1 | * | 10/2001 | Oliver et al. | 52/157 |
| 6,334,281 | B1 | * | 1/2002 | Oliver et al. | 52/157 |
| 6,871,455 | B1 | * | 3/2005 | Cockman et al. | 52/165 |
| 8,082,702 | B2 | * | 12/2011 | Hill | 52/155 |

* cited by examiner

*Primary Examiner* — Adriana Figueroa

(57) ABSTRACT

Herein described is a post anchor apparatus for erecting and anchoring posts in natural terrain. The apparatus of the present invention provides a convenient means of erecting a post in natural terrain while also providing improved strength, stability, and durability to the post. The apparatus comprises at least a housing for receiving the base of a post, a rod, stabilizer element for stabilizing the apparatus within the natural terrain, and an auger blade for driving the rod into the natural terrain.

12 Claims, 4 Drawing Sheets

POST ANCHOR APPARATUS

CROSS REFERENCE TO RELATED APPLICATIONS

This application is a continuation of U.S. patent application Ser. No. 13/944,803, filed on Jul. 17, 2013, now pending, which is a non-provisional and claims the benefit of U.S. Provisional Patent Application Ser. No. 61/672,980 filed Jul. 18, 2012. Each application identified above is incorporated here by reference in its entirety to provide continuity of disclosure.

BACKGROUND OF THE INVENTION

Anchoring a post in the ground typically involves the following steps. First, one must dig a deep narrow hole, insert the pole therein, partially fill the hole with concrete around the perimeter of the post, backfill the soil, and then add water. Following the setting of the concrete, installation of the fencing material may occur, unless the purpose is to install a bird house or a mail box in which case it is likely already attached to the post.

This method may be inexpensive but several disadvantages exist. Certain soil conditions may result in hole that is too large or make digging too difficult and strenuous. Digging equipment may be required. The application and mixing of concrete is also labor intensive, strenuous, and time consuming. If wooden, the buried portion of the post will degrade over time due to moisture exposure and the post strength will weaken potentially resulting in a break or crack of the wood.

Various attempts have been made to provide a structural device for convenient placement into the ground and post attachment. Devices to date involve insertion of structures within the ground that have large surface areas cooperating with one another to resist motion of the device. However, these devices generally lack acceptance in the industry because they are difficult or inconvenient to install and/or they lack sufficient structural resistance properties once installed to acceptably resist motion of the post above the ground. Furthermore, they may be expensive when compared to the conventional dig and concrete method. They also do not solve the problem of increased weakness in the post due to degradation from moisture exposure.

For these reasons there remains a need for a simple device for installation into the ground with minimal effort which is stable and provides for acceptable motion resistance, while not requiring any portion of the post to be underground.

BRIEF DESCRIPTION OF THE DRAWINGS

Representative embodiments of the invention are disclosed in more detail with reference to the drawings in which.

SUMMARY OF THE INVENTION

Herein described is a post anchoring apparatus for erecting, stabilizing, and supporting a post within natural terrain. The post anchoring system of the present invention generally comprises a housing for receiving the base of a post, a rod, at least one auger blade, and a stabilizer. In one embodiment, the housing comprises fastener bore holes for receiving fasteners for securing the base of the post in housing. In another embodiment, said housing comprises dimples which embed in the base of the post upon tightening of fasteners and constriction of housing about the post. Housing may further comprise an additional bore hole in the closed end of said housing for receiving a stabilizing crank pin.

The post anchoring system further comprises a rod that is driven into the terrain. The rod of the present invention may comprise one or more auger blades which upon rotation promotes downward movement of the rod and auger blade through the terrain. The rod of the present invention may further comprise a stop and a washer engaged thereto. Said stop and washer serve to restrict the relative movement of a stabilizer, which is also engaged to rod. Said stabilizer comprises a top face and at least four side faces and a bore hole within said top face for receiving the rod of the anchoring system of the present invention. In one embodiment, stabilizer is engaged to rod wherein it is allowed, to freely rotate about the axis of the rod and move vertically up and down the rod. In another embodiment, side faces comprise ground penetrating members which may be driven in the terrain to provide additional support to the post anchor system of the present invention. In a further embodiment the stabilizer comprises an additional bore hole which aligns with a matching bore hole on the closed end of the housing, each designed to receive the crank pin preventing rotational movement of the anchoring system as well as offering additional stability.

DESCRIPTION OF REPRESENTATIVE EMBODIMENTS

Further scope of applicability of the present invention will become apparent from the description of representative embodiments provided herein. However, it should be understood that the description and specific examples, while indicating embodiments of the invention, are given by way of illustration only, since various changes and modifications within the spirit and scope of the invention will become apparent to those skilled in the art.

Figure 1:
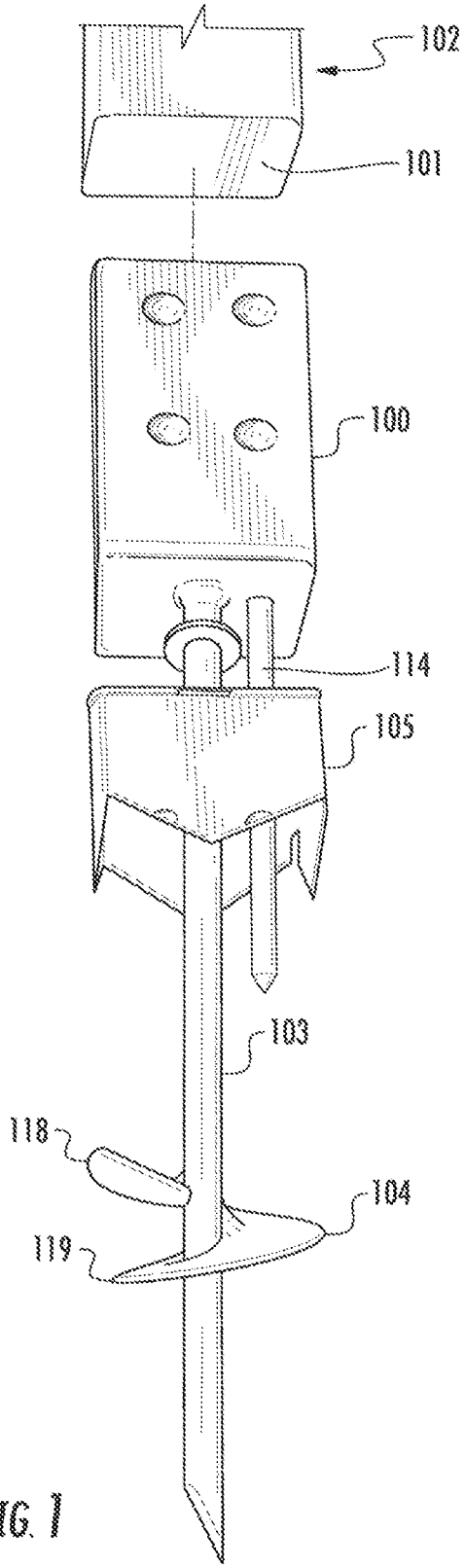
FIG. 1 depicts a side view of an embodiment of the present invention.

Referring now to FIG. 1, the post anchor system illustrated therein generally comprises housing 100 for receiving a base 101 of a post 102, a rod 103, at least one auger blade 104, and a stabilizer 105.

Figure 2:
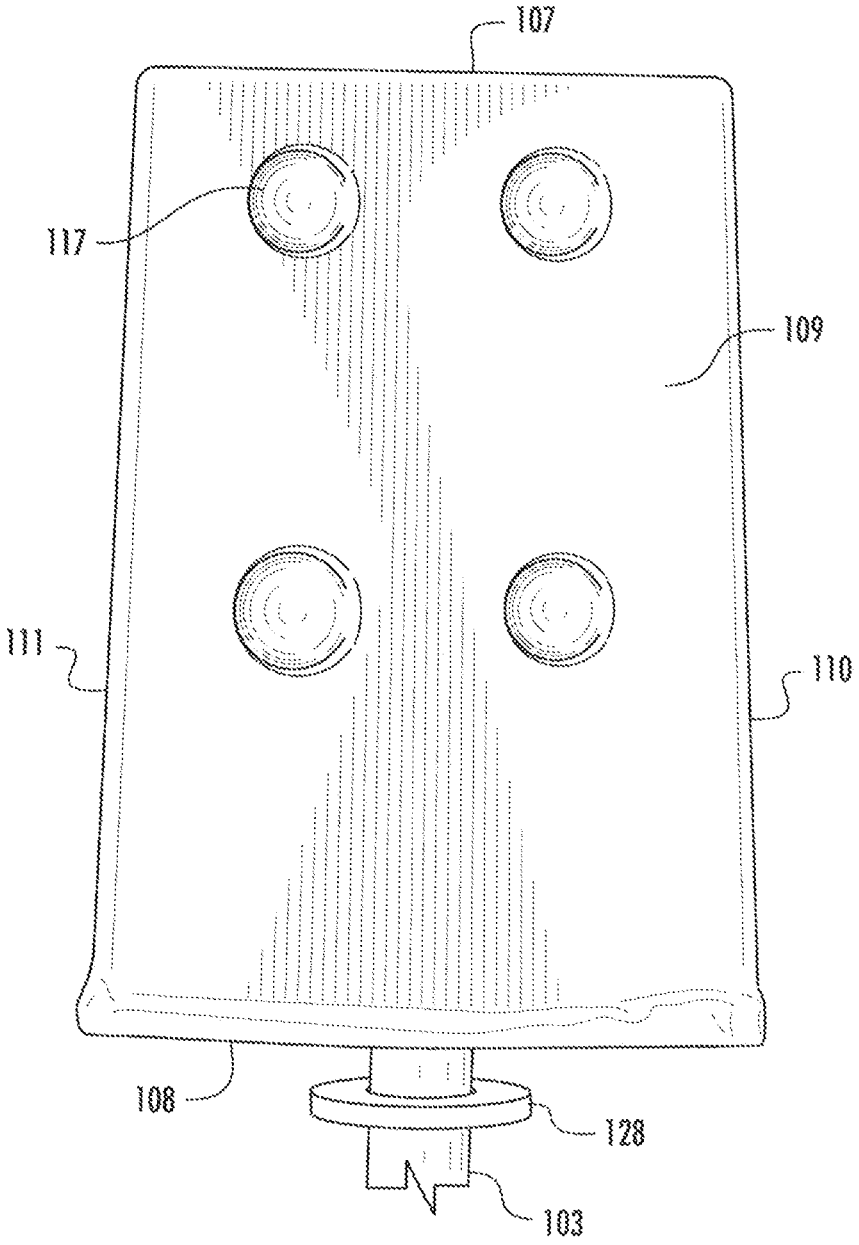
FIG. 2 depicts a side view of the housing.

The housing 100 depicted in FIGS. 1 and 2 is generally square or rectangular shaped, but it should be recognized by one of ordinary skill in the art that housing 100 may be configured to receive posts of any size and shape. Housing 100 must be sufficiently large of deep to receive enough of the base 101 of post 102 to vertically stabilize the remainder of post 102 and any attachment, such as a mailbox or bird house. A housing that is too shallow may result in the collapse or toppling of the post and attachment. For example, for standard mailbox and bird house designs, it has been observed that a suitable housing 100 depth needed to achieve the desired stability of the post and mailbox is about 6 inches.

Referring now to FIGS. 14, housing 100 comprises an open end 107 and a closed end 108 as well as faces 109, 110, 111, and 112. Housing 100 may further comprise opposing and matching bore holes 113*a* and 113*b* on opposite sides of the housing 100. Matching bore holes 113*a* and 113*b* are designed to receive crank pin 114 which, when properly inserted through housing 100, extends completely through housing chamber. The anchor system of the present invention further comprises a multi-purpose crank pin 114. Pin 114 is designed for insertion through bore holes 113*a* and 113*b*, Once inserted, the user may grip exposed ends of pin 114 to rotate housing 100, rod 103, and auger blade 104 about rod 103's axis of rotation. Rotation of this assembly in conjunction with minimal downward pressure drives the assembly into the terrain.

Figure 3:
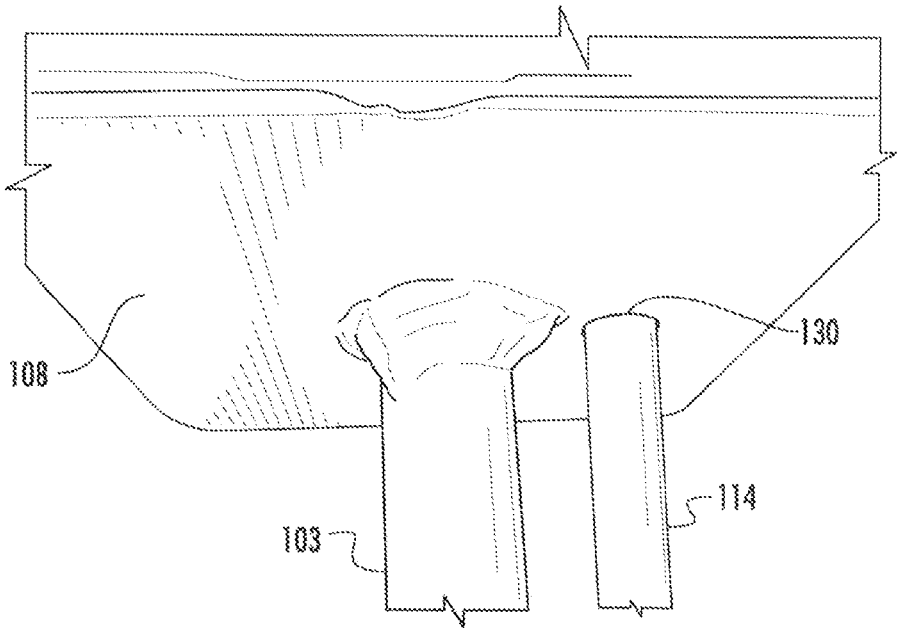
FIG. 3 depicts the underside of the housing and the rod's engagement thereto.
Figure 4:
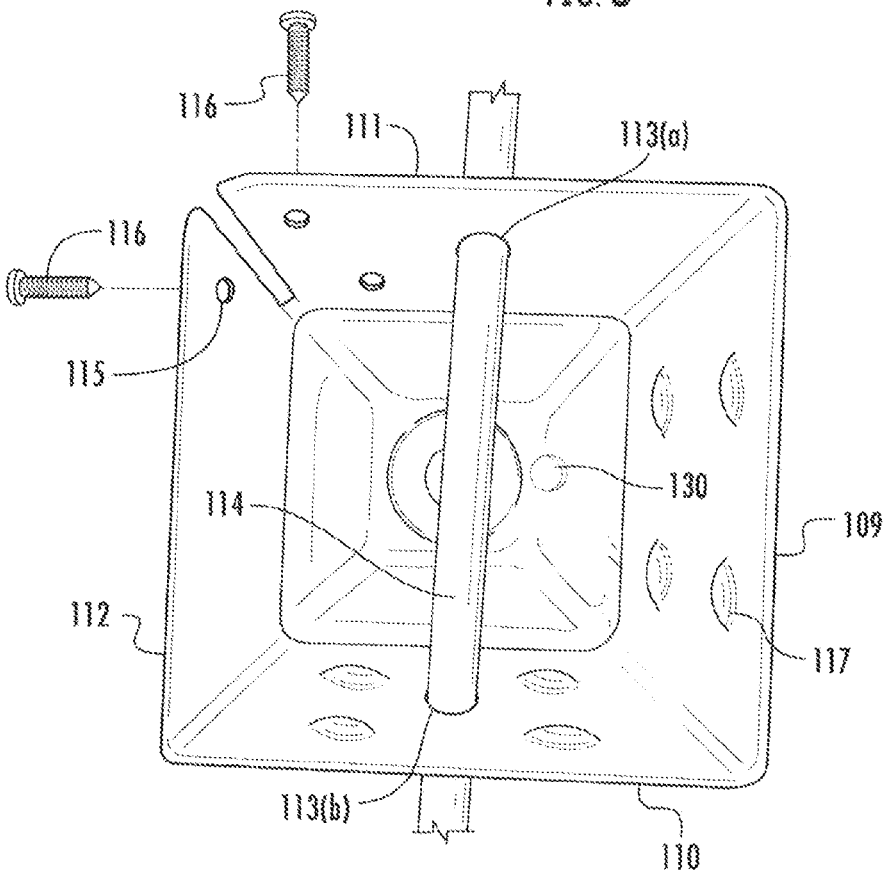
FIG. 4 depicts an interior view of the housing.

Referring now to FIG. 4, housing 100 may further comprise one or more bore holes 115 designed to receive post fasteners 116, which may include bolts, dowels, nails, nuts, pins, rivets, screws, and the like. Post fasteners 116 are driven into the base 101 of post 102 through bore hole 115 to secure post 102 within housing 100. In the embodiment shown in FIG. 4, the anchor system comprises three bore holes 115, two on side 111 and one on side 112. Housing 100 may additionally comprise one or more dimples 117 concave in relation to the exterior surface of housing 100 and convex in relation to the interior surface of housing 100. In the embodiment illustrated in FIGS. 1-2, and 3, housing 100 is shown with eight dimples, four dimples on each of two adjacent sides. Dimples 117 embed in post 102 as post fasteners 116 are tightened and driven into post 102.

Rod 103 is attached to and extends from dosed end of housing 108. Rod 103 engages closed end of housing 108 at the approximate center point of the housing's closed end 108. As illustrated in FIG. 1, rod 103 may additionally comprise one or more auger blades along its shaft to assist in driving rod 103 into the terrain. In the embodiment depicted in FIG. 1, rod 103 comprises a single auger blade 104 affixed thereto extending about 360' around rod 103. In the embodiment illustrated in FIG. 1, approximately 2 inches separate the terminus of top tongue 118 of auger blade 104 and the terminus of the lower tongue 119. This 2" gap between tongues 118 and 119 has been shown to promote movement of the rod and auger through most soil conditions and types with minimal effort on the user's part.

Figure 5:
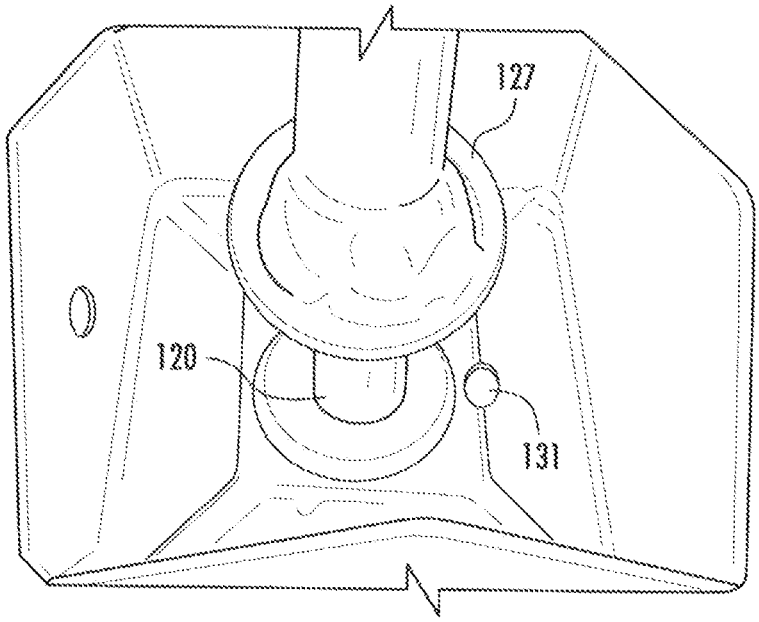
FIG. 5 depicts the underside of the stabilizer and the stop.
Figure 6:
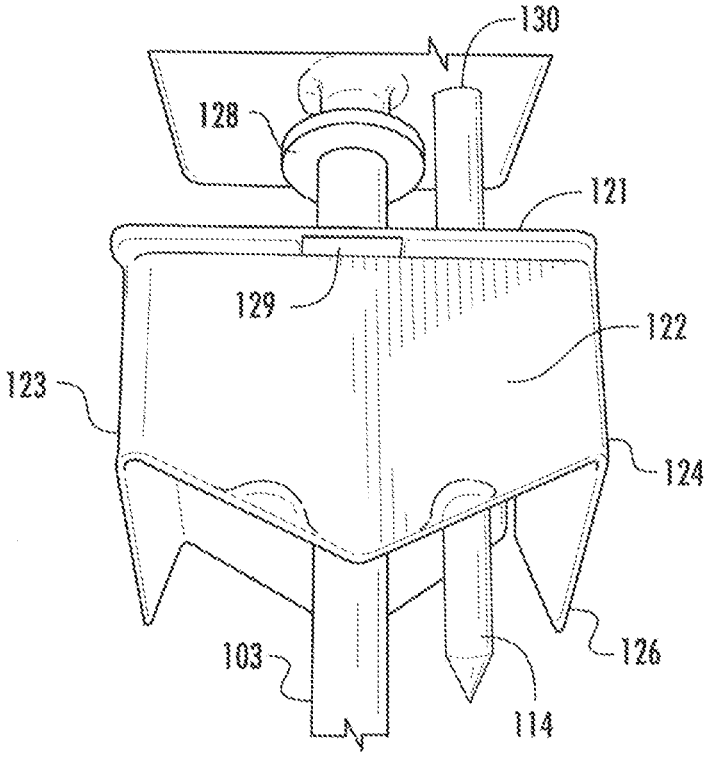
FIG. 6 depicts a side view of the stabilizer.

As illustrated, in FIGS. 1, 5, and 6, rod 103 additionally comprises a stabilizer 105 rotatably engaged thereto. Stabilizer 105 comprises bore hole 120 centrally located on first Face 121. Bore hole 120 is intended to receive rod 103 whereby stabilizer 120 may rotate freely about its axis as defined by rod 103. Stabilizer 105 may have one or more additional side faces (face 122, 123, 124, and 125 in the embodiment shown in FIG. 6) wherein each additional face is equipped with ground penetrating member 126. Ground penetrating member 126 may comprise any structure that promotes the insertion of said side faces into the ground and enhances stability and strength of the anchor system within the terrain.

Referring now to FIG. 5, rod 103 additionally comprises a stop 127 beneath bore hole 120. Stop 127 is permanently affixed to rod 103 in such a manner as to prevent further downward movement of stabilizer 105. As illustrated in FIG. 6, rod 103 further comprises a washer 128 engaged thereto positioned above first face 121 of stabilizer 105. Washer 128 is intended to prevent ward movement of stabilizer 105 past a specified point in order to provide sufficient space between stabilizer 105 and housing 100 whereby a user may conveniently insert a tool or foot to press stabilizer into the ground. In the embodiment shown in FIG. 5, the length between the stabilizer in its upper most position and the bottom of the housing, is about 1". This length provides sufficient depth of rod and auger blade and thereby stability while allowing a user to insert a tool the toe of a shoe to press the stabilizer securely in the ground.

Referring now to FIG. 5, stabilizer 105 also may be equipped with release elements 129 used to extricate stabilizer 105 from the ground. In the embodiment illustrated in FIG. 5, release elements 129 comprise elongated slots centrally positioned at the intersection between first face 121 and side faces. Release elements 129 are large enough to receive a crowbar, a screw driver, or the like suitable for prying stabilizer 105 out of the ground.

Once the anchor system is sufficiently driven into the ground via rotation of the rod 103 and auger blade 104, the user may apply pressure to stabilizer 105, for example foot pressure, to drive side faces into the ground. Stabilizer 105 is designed to provide extra surface area within and on the surface of the ground giving the anchor more stability and strength.

Referring now to FIGS. 1, 3 and 4, housing 100 has at least one additional bore hole 130 through closed end 108. Similarly, as shown in FIG. 5, stabilizer 105 has at least one additional bore hole 131 through first face 121. Stabilizer 105 may be rotated about rod 103 wherein bore hole 130 and bore hole 131 align. Prior to post insertion into housing 100 and once bore hole 130 and bore hole 131 are properly aligned, crank pin 114 may be inserted such that crank pin 114 passes through each bore hole 130 and 131. Crank pin 114, thus, may be driven into the terrain like a spike further stabilizing the post anchor system.

An embodiment of a method of erecting a post using the post anchoring apparatus described herein is described below. Once a user has selected the location for a post, the user may then drive the rod and auger blade into the ground using the pin 114 is designed for insertion through bore holes 113*a* and 113*b* in the housing. Once inserted, the user may grip exposed ends of pin 114 to rotate housing 100, rod 103, and auger blade 104 about rod 103's axis of rotation. Rotation of this assembly in conjunction with minimal downward pressure drives the assembly into the terrain. As the rod and auger blade are driven into the ground, the stabilizer 105 will come into contact with the ground and move up the rod 103 toward washer 128 until the stabilizer 105 contacts washer 128 preventing stabilizer 105 from further upward movement. At this point, the user may press the stabilizer into the terrain by the toe of his shoe or other suitable implement to add stability to the apparatus in the ground. The user may then drive the crank pin 114 into the ground through bore holes 130 and 131 after said bore holes are properly aligned. The user may then insert a post into housing and secure said post in said housing with post fasteners 116 inserted through bore holes 115. At this point the post is secure and erect within said housing.

It will be further apparent to those skilled in the art that various modifications and variations can be made in the device of the present invention without departing from the spirit or scope of the invention. Thus it is intended that the present invention cover the modifications and variations of this invention provided they come within the scope of the appended claims and their equivalents.

What is claimed is:

1. A post anchor apparatus comprising a housing for receiving a post, a rod, at least one auger blade, a crank pin, and a stabilizer comprising at least one bore hole in the upper surface for receipt of said crank pin, said housing comprising bore holes for receiving post fasteners to secure said housing to said post, at least two matching bore holes on opposite faces of said housing for receiving said crank pin for mechanical rotation of said auger to drive said rod and auger blade into the ground, one or more dimples for additional stabilizing engagement with said post, and at least one bore hole in a bottom surface of said housing configured to be aligned with said bore hole in said stabilizer's upper surface for receiving said crank pin for added stability.

2. The post anchor apparatus of claim 1 wherein said stabilizer further comprises one or more ground penetrating members, a central bore for receipt of said rod there through, one or more release elements.

3. The post anchor apparatus of claim 1 wherein said auger bladecomprises an upper and lower tongue that are 2" apart.

4. The post anchor apparatus of claim 1 wherein said rod comprises a washer engaged thereto above said stabilizer and below said housing for prevention of said stabilizer from rising greater than the desired distance as the apparatus is driven into the ground.

5. The post anchor apparatus of claim 4 wherein said washer is positioned about 1" from the underside of said housing at its uppermost position.

6. A post anchor apparatus comprising a housing for receiving a post, a rod, at least one auger blade, a stabilizer and a crank pin, said housing comprising at least two matching bore holes on opposite faces of said housing for receiving said crank in for mechanical rotation of said auger to drive said rod and auger blade into the ground, wherein said stabilizer further comprises at least one bore hole in an upper face for receipt of said crank pin and wherein said housing further comprises at least one bore hole in a bottom face configured to be aligned with said bore hole in said stabilizer's upper face for receiving said crank pin for added stability when said stabilizer is pressed into the ground and said crank pin is driven through said aligned bore holes and into the ground.

7. The post anchor apparatus of claim 6 wherein said housing further comprises bore holes for receiving post fasteners to secure said housing to said post, at least two matching bore holes on opposite faces of said housing for receiving said crank pin for mechanical rotation of said auger to drive said rod and auger blade into the ground, and one or more dimples for additional stabilizing engagement with said post.

8. The post anchor apparatus of claim 6 wherein said stabilizer further comprises a central bore for receipt of said rod there through and one or more release elements comprising elongated slots centrally positioned at the intersection of said top face and side faces.

9. The post anchor apparatus of claim 6 wherein said auger blade comprises an upper and lower tongue that are 2" apart.

10. The post anchor apparatus of claim 6 wherein said rod comprises a washer engaged thereto above said stabilizer and below said housing for prevention of said stabilizer from rising greater than the desired distance as the apparatus is driven into the ground.

11. The post anchor apparatus of claim 10 wherein said washer is positioned about 1" from the underside of said housing at its uppermost position.

12. The post anchor apparatus of claim 2 wherein said one or more release elements comprise elongated slots centrally positioned at the intersection of said top face and side faces.

* * * * *